United States Patent [19]

Saruta et al.

[11] 4,370,966

[45] Feb. 1, 1983

[54] FUEL FEED SYSTEM

[75] Inventors: Masahiro Saruta; Hiroki Uchiyama, both of Iwata, Japan

[73] Assignee: NTN Toyo Bearing Co., Ltd., Osaka, Japan

[21] Appl. No.: 24,166

[22] Filed: Mar. 26, 1979

[51] Int. Cl.[3] ..... F02M 39/02; F02M 45/00

[52] U.S. Cl. ..... 123/447; 123/511; 123/514

[58] Field of Search ..... 261/34 A, 50 A, 36 A; 123/179 L, 299, 300, 304, 452, 453, DIG. 2, 445–447, 510–514, 139 AW, 139 BG

[56] References Cited

U.S. PATENT DOCUMENTS

| | | | |
|---|---|---|---|
| 2,641,237 | 6/1953 | Deschamps | 261/34 A X |
| 3,013,545 | 12/1961 | Noftz et al. | 123/512 |
| 3,211,438 | 10/1965 | Possell | 261/36 A |
| 3,437,081 | 4/1969 | Mennesson | 261/34 A |
| 3,608,532 | 9/1971 | Balluff | 123/139 AW X |
| 3,796,413 | 3/1974 | Woods | 261/36 A X |
| 4,025,588 | 5/1977 | Nakamura et al. | 261/34 A |
| 4,050,431 | 9/1977 | Jackson | 123/139 AW |
| 4,055,609 | 10/1977 | Phelps | 123/139 AW X |
| 4,119,066 | 10/1978 | Happel | 123/139 AW X |
| 4,132,211 | 1/1979 | Wilfert et al. | 123/179 L |
| 4,144,858 | 3/1979 | Bertling et al. | 261/36 A X |
| 4,157,084 | 6/1979 | Wallis | 123/139 AW X |
| 4,159,014 | 6/1979 | Szott et al. | 261/34 A X |

FOREIGN PATENT DOCUMENTS

| | | | |
|---|---|---|---|
| 52-13036 | 2/1977 | Japan | 261/34 A |

*Primary Examiner*—William D. Martin, Jr.
*Attorney, Agent, or Firm*—Armstrong, Nikaido, Marmelstein & Kubovcik

[57] ABSTRACT

A fuel feed system adapted to maintain at a constant value the pressure difference across a fuel measuring gate disposed in a fuel feed passage and control the area of opening of the fuel measuring gate in connection with the amount of air being sucked into an internal combustion engine so as to continuously measure the fuel, the measured fuel being concentratedly injected at a positive pressure into the suction pipe. The system comprises an accelerator pump interlocked to a throttle valve for injecting fuel at a positive pressure into the suction pipe during acceleration. The accelerator pump is fed with fuel sucked up from the return pipe of a pressure regulator which feeds the fuel measuring gate with fuel at a predetermined pressure.

2 Claims, 4 Drawing Figures

FUEL FEED SYSTEM

BACKGROUND OF THE INVENTION (a) Field of the Invention

The present invention relates to an accelerating and supplementing mechanism for use in a fuel feed system and particularly to an accelerating and supplementing mechanism for use in a fuel feed system of the type which continuously measures fuel and concentratedly injects it at a positive pressure into a suction pipe.

(b) Description of the Prior Art

There is known a fuel system of a continuous measuring and concentrated injecting type which, as shown in FIG. 1, comprises a fuel measuring mechanism A comprising a tapered hole 2 arranged in a main body 1, a valve 3 axially slidably installed in the hole 2 and a pressure control unit 4 for maintaining the pressure difference across the valve 3 at a predetermined value, and a flow rate measuring mechanism B which maintains, at a predetermined value, the pressure difference $P_1-P_2$ across a flow rate detecting valve 6 disposed in a suction pipe by means of a servo-mechanism (not shown) and measures the amount of air being sucked on the basis of degree of opening of the flow detecting valve 6, wherein unique correspondence between the degree of opening of the flow rate detecting valve 6 and the axial position of the valve 3 is established by a control rod 7.

The feed fuel system of the type described above is arranged so that when the accelerator pedal is operated, the pressure $P_2$ downstream of the flow rate detecting valve 6 is varied and therefore the flow rate detecting valve 6 is displaced until the pressure difference $P_1-P_2$ assumes a predetermined value. This displacement is transferred to the valve 3 by the control rod 7 to vary the axial position of the valve 3 so that the clearance defined between the valve 3 and the hole 2 varies in size.

The pressure difference across the valve 3 is maintained at a constant value by the pressure control unit 4 and the fuel flows through the clearance at a fixed speed and is injected into the suction pipe 5 by a nozzle 9 disposed upstream of a throttle valve 8 on the primary side. In addition, 10 designates a venturi for assisting in the atomization of fuel injected and 11 designates a bypass which connects the venturi to the upstream side of the flow rate detecting valve 6.

With the system shown in FIG. 1, however, it is impossible to increase the follow-up characteristic of quick acceleration to the required degree, thus giving the driver an impression that the accelerating ability is poor.

SUMMARY OF THE INVENTION

The present invention provides a fuel feed system of the type adapted to maintain at a constant value the pressure difference across a fuel measuring gate disposed in a fuel feed passage and control the area of opening of said fuel measuring gate in connection with the amount of air being sucked into an internal combustion engine to continuously measure fuel so as to concentratedly inject the measured fuel at a positive pressure into the suction pipe during acceleration, said system being characterized in that it includes an accelerator pump interlocked to a throttle valve for injecting fuel at a positive pressure into the suction pipe, said accelerator pump being fed with fuel sucked up from the return pipe of a pressure regulator which feeds the fuel measuring gate with fuel at a predetermined pressure.

FEATURES OF THE INVENTION

According to the invention, since the fuel feed system is provided with an accelerator pump interlocked to the throttle valve for injecting fuel at a positive pressure into the suction pipe during acceleration and said accelerator pump is fed with fuel sucked up from the return pipe of the pressure regulator which feeds said fuel measuring gate with fuel at a predetermined pressure, there is no delay in effecting quick acceleration. Further, since fuel at low pressure is sucked up from the return pipe, sealing is easy and the construction is simple.

DESCRIPTION OF THE PREFERRED EMBODIMENTS

Figure 1:
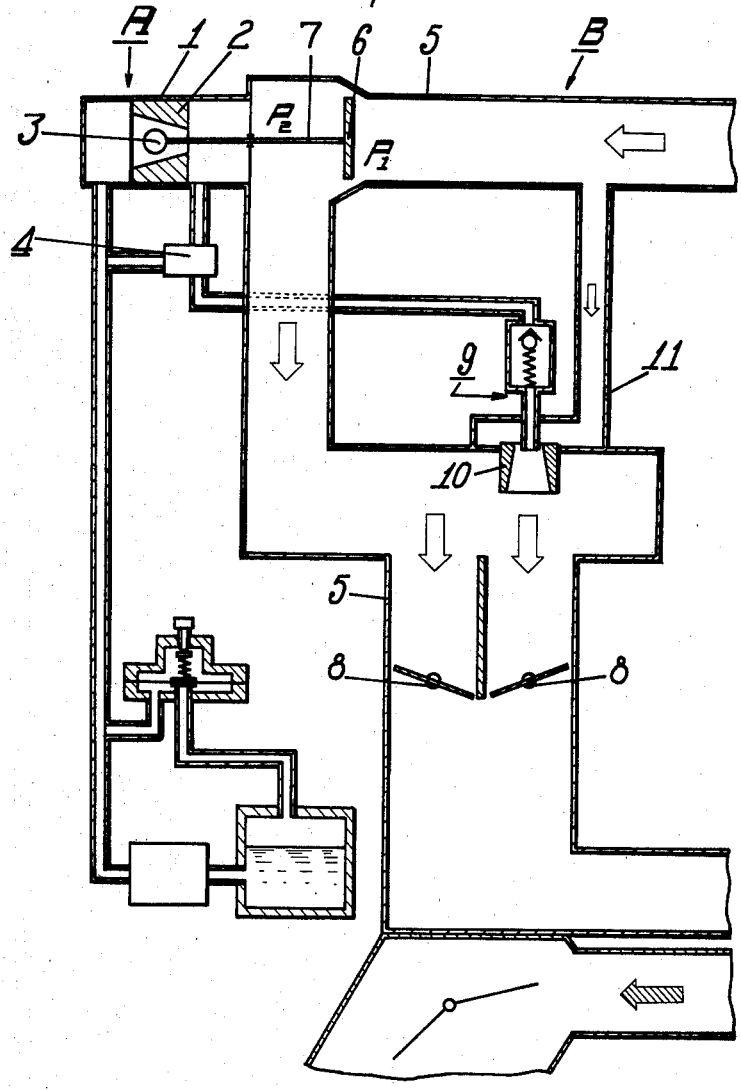
PRIOR ART Fig. 1
FIG. 1 is a schematic view of a known fuel feed system of the continuous measuring and concentrated injecting type.

FIG. 1 shows a fuel feed system of the continuous measuring and concentrated injecting type which comprises a fuel measuring mechanism A comprising a tapered hole 2 arranged in a main body 1, a valve 3 axially slidably installed in said hole 2, and a pressure control unit 4 for maintaining the pressure difference across said valve 3 at a predetermined value, and a flow rate measuring mechanism B which maintains at a predetermined value the pressure difference $P_1-P_2$ across a flow rate detecting valve 6 disposed in a suction pipe by means of a servomechanism (not shown) and measures the amount of air being sucked on the basis of the degree of opening of the flow rate detecting valve 6, wherein unique correspondence between the degree of opening of the flow rate detecting valve 6 and the axial position of the valve 3 is established by a control rod 7.

The fuel feed system of the type described above is arranged so that when the accelerator pedal is operated, the pressure $P_2$ downstream of the flow rate detecting valve 6 is varied and therefore the flow rate detecting valve 6 is displaced until the pressure difference $P_1-P_2$ assumes a predetermined value. This displacement is transferred to the valve 3 by the control rod 7 to vary the axial position of the valve 3, so that the clearance defined between the valve 3 and the hole 2 varies in size.

The pressure difference across the valve 3 is maintained at a constant value by the pressure control unit 4 and the fuel flows through the clearance at a fixed speed and is injected into the suction pipe 5 by a nozzle 9 disposed upstream of a throttle valve 8 on the primary side. In addition, 10 designates a venturi for assisting in the atomization of fuel injected and 11 designates a bypass which connects said venturi to the upstream side of the flow rate detecting valve 6.

With the system shown in FIG. 1, however, it is impossible to increase the follow-up characteristic of quick acceleration to the required degree, thus giving the driver an impression that the accelerating ability is poor.

Figure 2:
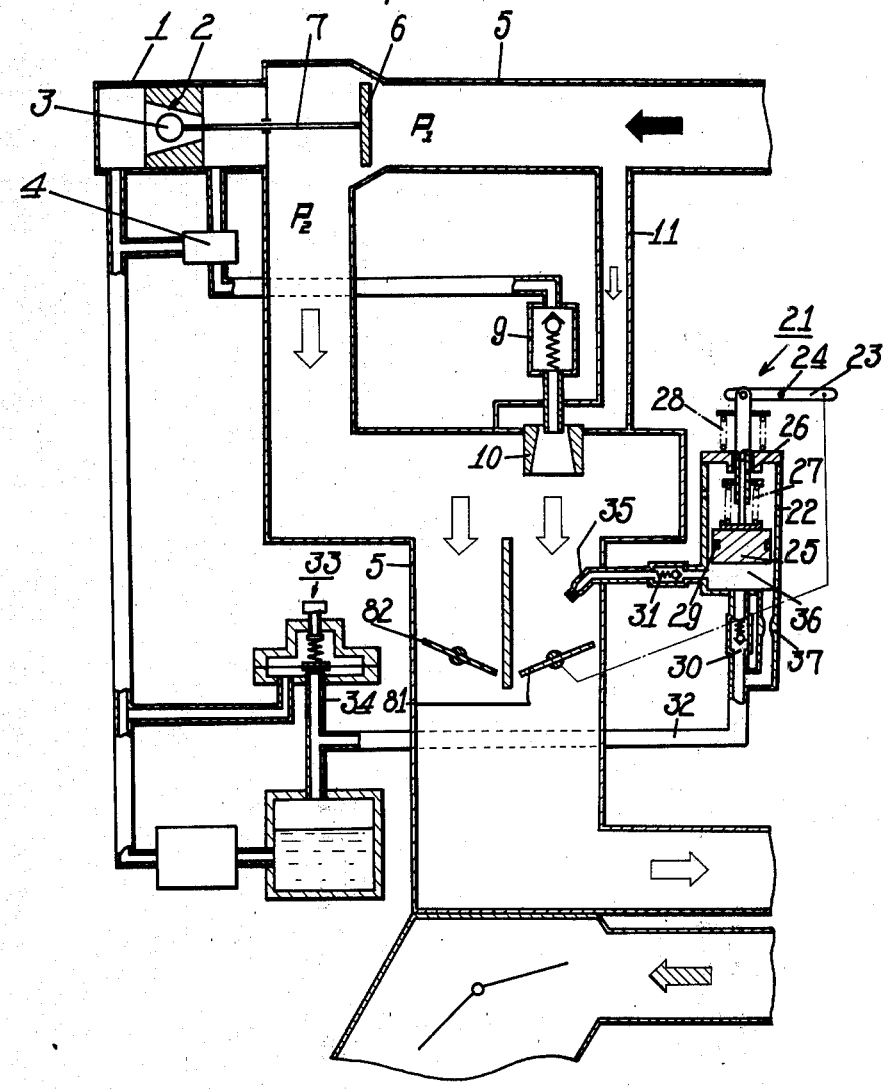
FIG. 2 is a schematic view of an accelerating and supplementing mechanism for use in a fuel feed system according to the present invention.

Referring to FIG. 2 showing a preferred embodiment of the invention, 21 designates an accelerator pump; 22 designates a main body; and 23 designates a lever pivoted at a fulcrum 24 and interlocked to a throttle valve 81 through a linkage. The numeral 25 designates a piston adapted to slide within the main body 22 as the lever 23 is displaced; 26 designates a presser link; 27 and 28 designate springs; 29 designates a seal ring for the piston 25; 30 and 31 designate check valves on the fuel inlet and outlet sides, respectively; 32 designates a pipe connecting the return pipe 34 of a pressure regulator 33 to the inlet side of the accelerator pump 21. Designated at 35 is a nozzle for injecting accelerative and supplementary fuel into the suction pipe 5.

The operation of the accelerator pump 21 is as follows.

The accelerator pump 21 is interlocked to the throttle valve 81 on the primary side through a linkage so that when the accelerator pedal (not shown) is stepped on, the lever 23 is displaced upward as viewed in the illustration to flex the spring 27 downward as viewed in the illustration. As a result, the spring force acting on the piston 25 is increased, until the fuel in a chamber 36 is injected at a predetermined pressure into the suction pipe 5 through the check valve 31. In addition, the check valve 32 on the secondary side is of the known construction interlocked to the valve 81 on the primary side. When the presser link 26 is displaced upward as viewed in the illustration by the spring 28, the spring force of the spring 27 decreases, displacing the piston 25 upward. At this time, the chamber 36 is filled with fuel passing through the return pipe 34 of the pressure regulator 33 the pipe 32 and the check valve 30. In addition, the numeral 37 designates a choke provided for allowing the fuel in the chamber 36 to leak when the movement of the throttle valve 81 is slow.

Figure 3:
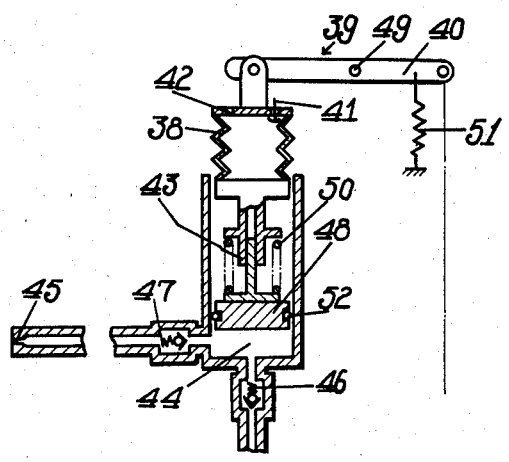
FIG. 3 shows a second embodiment of the invention.

FIG. 3 shows an accelerator pump according to a second embodiment of the invention. In FIG. 3, 39 designates an accelerator pump; 38 designates a bellows interlocked to a lever 40; and 41 and 42 designate a check valve and a choke, respectively, which are provided in the bellows. According to this embodiment, when the movement of the throttle valve is slow, the air in the bellows 38 leaks out through the choke 42, so that the presser link 43 makes no displacement. However, when the movement of the throttle is quick as in the case of quick acceleration, the volume of the bellows 38 hardly varies, so that the presser link 43 is displaced downward as viewed in the illustration to inject the fuel contained in the chamber 44 into the suction pipe. When a downward pull is applied to the lever 40, the open air is introduced into the bellows 38 through the check valve 41. In addition, in FIG. 3, the numerals 46 and 47 designate check valves; 48 designates a piston; 49 designates a fulcrum for the lever; 50 and 51 designate springs; and 52 designates a seal ring.

Figure 4:
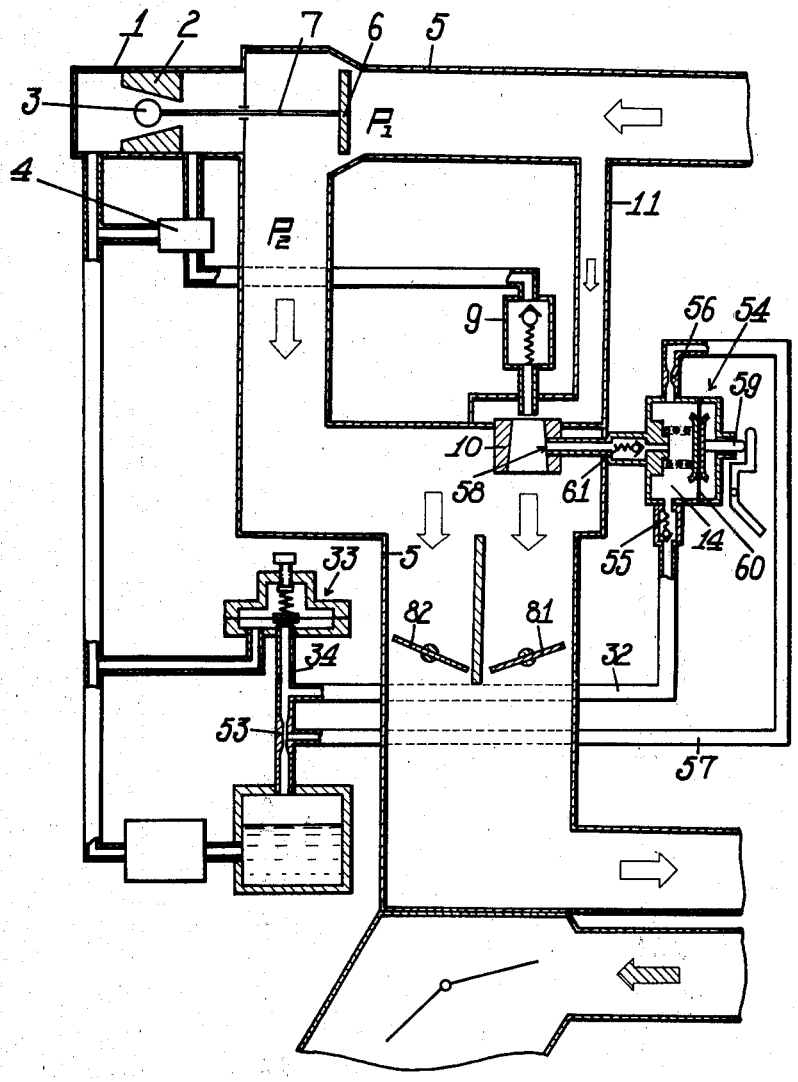
FIG. 4 shows a third embodiment of the invention.

FIG. 4 shows a system according to a third embodiment of the invention, wherein an orifice 53 is placed in the return pipe 34 of the pressure regulator 33 and the upstream side of said orifice 53 is connected to the chamber 14 of an accelerator pump 54 through a pipe 32 and check valve 55. The top of the chamber 14 is provided with an orifice 56, which is connected to said orifice 53 in the return pipe 34 through a pipe 57. Further, the delivery port 58 of the accelerator pump 54 opens to a venturi 10. Because of this arrangement, a small amount of fuel is circulating at all times in a loop through the pipe 32, check valve 55, chamber 14, orifice 56 and pipe 57. The orifice 56 has a small bore such that when a rod 59 interlocked to the throttle valve 81 is abruptly pushed, a diaphragm 60 is moved to the left to press the fuel in the chamber 14. As soon as the pressure in the chamber 14 exceeds the valve opening pressure of a check valve 61, the fuel is injected into the venturi 10 through a nozzle 58.

According to this third embodiment of the invention, since fuel is circulating through the chamber 14 at all times, there is no possibility of air bubbles staying in the chamber 14, so that the operation of the accelerator pump is stabilized. Further, if the throttle valve is slowly operated, the accelerator pump delivers little fuel, contributing to the saving of fuel. Since the delivery port opens to the venturi 10, the fuel delivered from the accelerator pump is atmozed by air currents. Therefore, the distribution of fuel to the respective cylinders becomes uniform, involving no loss of fuel.

Whiles there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. In a fuel injection system for an internal combustion engine operating with continuous fuel injection into a suction pipe, said suction pipe including a first portion and a second portion downstream of said first portion, a throttle valve in said second portion, said system including a fuel measuring gate having a fuel control aperture, a sensor member positioned between said first and second portions and being moveable in proportion to the quantity of air flowing therebetween, said sensor member being operatively coupled to said fuel control gate to determine the size of said aperture to control the amount of fuel therethrough, a bypass line coupled between said first and second portions, and a pressure regulator coupled to said fuel measuring gate to supply fuel thereto at a predetermined pressure, said regulator having a return pipe, said continuous fuel injection from said fuel measuring gate being into said second portion; the improvement comprising an accelerator pump interlocked to said throttle valve for injecting additional fuel at a positive pressure through a delivery port during acceleration, said accelerator pump being coupled to and drawing fuel from said return pipe, said delivery port opening into said second portion at a position different than said continuous injection.

2. In a fuel injection system for an internal combustion engine operating with continuous fuel injection into a suction pipe, said suction pipe including a first portion and a second portion downstream of said first portion, a throttle valve in said second portion, said system including a fuel measuring gate having a fuel control aperture, a sensor member positioned between said first and second portions and being moveable in proportion to the quantity of air flowing therebetween, said sensor member being operatively coupled to said fuel control gate to determine the size of said aperture to control the amount of fuel therethrough, a bypass line coupled between said first and second portions, and a pressure regulator coupled to said fuel measuring gate to supply fuel measuring gate to supply fuel thereto at a predetermined pressure, said regulator having a return pipe, said continuous fuel injection from said fuel measuring gate being into said second portion; the improvement comprising an accelerator pump interlocked to said throttle valve for injecting additional fuel at a positive pressure through a delivery port during acceleration, said accelerator pump being coupled to and drawing fuel from said return pipe, said delivery port opening into said second portion at a position different than said continuous injection during acceleration, said accelerator pump including a pressure chamber and a delivery port, said pressure chamber drawing fuel from said return pipe through a pipe means, said pipe means including an orifice therein, said system further including a venturi in said second portion fed with air through said bypass, said fuel measuring gate continuously feeding fuel centrally of said venturi, said delivery port opening into a side portion of said venturi.

* * * * *